US005353611A

United States Patent [19]

Wade et al.

[11] Patent Number: 5,353,611

[45] Date of Patent: Oct. 11, 1994

[54] APPARATUS AND METHOD FOR MAKING STABLE FABRIC WITH A WARP KNITTING MACHINE

[75] Inventors: Heinz Wade, Rodgau; Gerhard Bergmann, Heusenstamm, both of Fed. Rep. of Germany

[73] Assignee: Karl Mayer Textilmaschinenfabrik GmbH, Obertshausen, Fed. Rep. of Germany

[21] Appl. No.: 719,785

[22] Filed: Jun. 24, 1991

[30] Foreign Application Priority Data

Jun. 28, 1990 [DE] Fed. Rep. of Germany ..... 4020550

[51] Int. Cl.[5] ..... D04B 23/00

[52] U.S. Cl. ..... 66/207

[58] Field of Search ..... 66/204, 207, 135, 192, 66/193, 195, 84 R, 203, 84 A, 81, 85 R, 85 A, 205, 214, 138

[56] References Cited

U.S. PATENT DOCUMENTS

| | | | |
|---|---|---|---|
| 3,331,549 | 9/1967 | Morse | 66/192 |
| 3,340,134 | 9/1967 | Porter et al. | 66/195 |
| 3,413,825 | 12/1968 | Winch | 66/192 |
| 4,015,451 | 4/1977 | Gajjar | 66/195 |
| 4,044,575 | 8/1977 | Krug | 66/192 |
| 4,067,210 | 1/1978 | Arons et al. | 66/203 |
| 4,240,275 | 12/1980 | Fiedler | 66/203 |
| 4,549,414 | 10/1988 | Zorini et al. | 66/204 X |
| 4,570,462 | 2/1986 | Roth | 66/204 |
| 4,807,450 | 2/1989 | Weiland | 66/202 |
| 5,150,587 | 9/1992 | Bergmann | 66/195 |

FOREIGN PATENT DOCUMENTS

| | | | |
|---|---|---|---|
| 2939846 | 4/1981 | Fed. Rep. of Germany | 66/207 |
| 3023952 | 1/1982 | Fed. Rep. of Germany | 66/207 |
| 3130555 | 2/1983 | Fed. Rep. of Germany | 66/207 |
| 3321733 | 12/1984 | Fed. Rep. of Germany | 66/207 |

*Primary Examiner*—Clifford D. Crowder
*Assistant Examiner*—Larry D. Worrel, Jr.
*Attorney, Agent, or Firm*—Omri M. Behr; Matthew J. McDonald

[57] ABSTRACT

There is provided a warp knitting machine with a weft thread arrangement M having two jacquard guide bars 11 and 12. These are subject to shogging in the sense of a tricot stitch. In substantially each working cycle, a portion of the guides 13 of first jacquard guide bar 11 are displaced in the sense of a pillar stitch. The selection of the so displaced guides alters itself, but periodically. Thus certain needles 7 remain unlaid by warp threads of the first guide bar 11. The guides bar 14 of the second jacquard guide bar 11 lay warp threads around the said needle 11 left free by the warp threads of guide bars 11 while laying thread around other needles 7. This permits the provision of a patterned fabric which is exceedingly stable two-dimension.

15 Claims, 5 Drawing Sheets

APPARATUS AND METHOD FOR MAKING STABLE FABRIC WITH A WARP KNITTING MACHINE

BACKGROUND OF THE INVENTION

1. Field of the Invention

The present invention is directed to a warp knitting machine having a needle bed and guide bars operating therewith for the provision of a warp thread system comprising a shogging control arrangement and a magazine weft thread arrangement for the provision of weft threads.

2. Description of the Related Art

In known warp knitting machines of this type it is possible to provide a very stable fabric two-dimensionally utilizing weft threads together with pillar stitches. Such fabric however cannot be surface patterned. If one utilizes another stitch formation such as tricot, tuch, atlas, and their combinations one already obtains, even without the weft threads, a ground fabric which hangs together. The weft threads therefore serve substantially to provide transverse stability, however one has to take into consideration a disturbing lateral extendability.

The problem to be solved by the present invention, is to provide a warp knitting machine of the aforementioned type, which permits the provision of a substantially stable fabric two-dimensionally with a new type of surface patterning.

SUMMARY OF THE INVENTION

In accordance with the illustrative embodiments demonstrating features and advantages of the present invention, there is provided a warp knitting machine for forming fabric from weft threads and warp threads. The machine has a needle bed having a plurality of needles and a magazine weft thread arrangement for providing the weft threads to the needle bed. The machine also has first and second jacquard guide bars operative with the needle bed for providing a system of warp threads. Also includes is first and second shogging control arrangements for reciprocating the first and second jacquard guide bars in the sense of a tricot stitch. A first and second plurality of guides are mounted on the first and second jacquard guide bars, respectively. Each of the guides has a displacing element operable to effectively displace the first and second plurality of guides over one needle space. The machine also has a jacquard control arrangement for controlling the displacing element in the first and second plurality of guides. This jacquard control arrangement, in substantially each working cycle, can displace a given portion of the first plurality of guides in the sense of a pillar stitch. This given portion of the guides has their motion periodically altered to cause reserved ones of the needles to be devoid of warp threads from the first jacquard guide bar, while the jacquard control arrangement controls the guides of the second jacquard guide bar to lay warp threads about the reserved ones of the needles, together with the other ones of the needles.

In a related method of the same invention fabric is formed from weft threads and warp threads with a warp knitting machine. This machine has a needle bed with a plurality of needles, a magazine weft thread arrangement, and a first and second jacquard guide bar with a first and second plurality of guides, each with a displacing element. The method includes the step of providing the weft threads to the needle bed. Another step in the method is reciprocating the first and second jacquard guide bars laterally in the sense of a tricot stitch. The method also includes the step of controlling the displacing element in the first and second plurality of guides, in substantially each working cycle, by displacing a given portion of the first plurality of guides in the sense of a pillar stitch. This given portion of the guides have their motion periodically altered to cause reserved ones of the needles to be devoid of warp threads from the first jacquard guide bar, while controlling the guides of the second jacquard guide bar to lay warp threads about the reserved ones of the needles, together with the other ones of the needles.

Thus advantages flow from apparatus and methods of the foregoing type wherein preferably both of the forward guide bars are jacquard guide bars having displacing elements controlled by a jacquard control arrangement, which can displace the guides by one needle space. Moreover, a preferred shogging control arrangement can move both jacquard guide bars in the sense of a tricot stitch. Accordingly in substantially each working cycle, a portion of the guides of the first jacquard guide bar are moved in the sense of a pillar stitch. The selection of the so displaced guides is altered by within a given periodically, so that certain needles remain unlaid by threads from the first jacquard guide bar. The jacquard control arrangement of the second guide bar so controls its guides that the needles unlaid by threads from the first jacquard guide bar are laid about by threads of the second guide bar at the same time as other needles are laid about.

This control arrangement ensures that in substantially each working cycle a portion of the guides lay pillar stitches and another portion of the guides lay other stitch types and that substantially each guide sequentially forms pillar stitches and thereafter other stitches.

This mode of construction permits the formation of surface patterning because within each working cycle different stitch types can be utilized and each guide can be programmed to form different stitch types. This permits the leg segments of the stitches to be differently laid over the weft threads so that, different coverings of the weft threads are obtained. In particular, this leads to patterns which have the appearance of woven goods.

It is necessary that in each work cycle a portion of the stitches are laid as pillar stitches. This is possible because each pillar segment, in combination with the weft threads, forms a firm ground fabric segment. The pillars furthermore ensure that the additional segment formed by other stitch types only has a limited lateral extendability and thus by the proper distribution of the different areas there is provided a fabric of substantial surface stability.

The second jacquard guide bar works with the first jacquard guide bar and contributes to the patterning provided by the stitch leg laid by it. Thus there may be obtained a plurality of similar and different stitch formations which have a different covering relationship with respect to the weft threads.

The shogging control arrangement which moves the jacquard bars in the sense of a tricot stitch, makes it further possible that the individual guides are selectively, at one end of the shogging, displaced in the sense of a pillar stitch and at the other end in the sense of a tuch stitch. Only by displacement of the guides at different times, is it possible to obtain not only pillar and tricot stitches, but also tuch stitch. Since this possibility exists for both jacquard guide bars, it is possible to cover the weft threads with similar lapping forms such as pillar-pillar, tricot-tricot, tuch-tuch and also unequal lapping types such as pillar-tricot and tricot-tuch, both running in the same direction and also transversely. It is desirable to provide that the first jacquard guide bar is the forward guide bar. This therefore carries through the main patterning.

In the simplest case it is sufficient that the two jacquard guide bars are the sole guide bars. This gives rise to a machine of simple construction. It also gives a light, patterned fabric which is formed solely of a two thread warp thread system and a single weft thread system.

In a preferred embodiment it is provided that, the two jacquard guide bars are laterally moved in opposite directions and that their guides are displaceable in opposite directions. A common jacquard arrangement is provided so that for the pairs of guides of both jacquard guide bars which form a tricot stitch around the same needles, there is only one control element. It has been shown that under the aforementioned conditions, without substantial influence on the patterning possibility, it is possible to control the corresponding guides of both jacquard guide bars with a single control element of a common jacquard control arrangement, whereby these needles are laid about in a mirror image fashion. The reduction of the control elements leads to a substantial cost savings, as well as corresponding footprint and weight saving.

DESCRIPTION OF THE PREFERRED EMBODIMENTS

Figure 1:
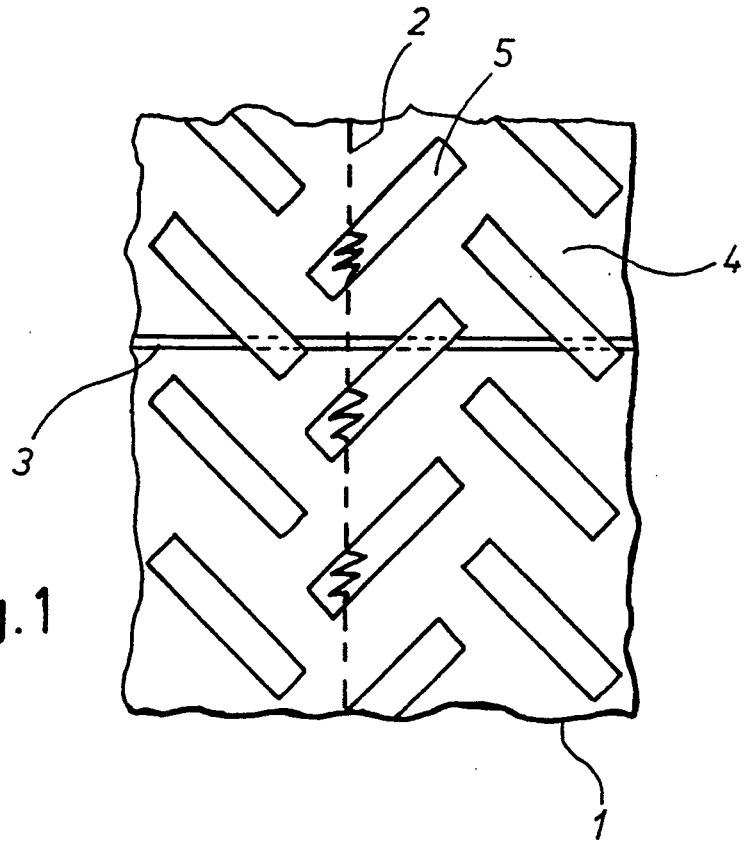
FIG. 1 is a schematic plan view of a segment of fabric produced in accordance with the present invention.

FIG. 1 shows a fragment of fabric 1 which is formed from warp threads 2 and is interlaced with weft threads 3. There is formed a first area 4 in which the warp threads 2 are laid in pillar stitch and a second segment 5 in which the warp threads 2 are laid in a different stitch form; in particular, tricot or tuch. This is indicated merely schematically in the drawing.

In the second segment 5, the warp threads 2 have a stronger covering action with respect to the weft threads 3 so that an optical effect is achieved not only through different layings of the visible and covered portions of the weft threads. In particular, it is thus possible to achieve the effect of a surface patterned woven fabric.

The weft threads 3 interfere with stretching in the transverse direction. The longitudinal extension is controlled by the warp threads, wherein each warp thread has a reduced longitudinal extension in the area of the pillar stitch binding and permits a greater extension in the area of the other stitch formations. However the latter only has a limited effect since on both sides of the second area 5, pillar stitch warp threads are located. This gives rise to a very substantial level of surface stability. Stretching or buckling of the fabric is substantially prevented by an adequate alternation between the first and second areas.

Figure 2:
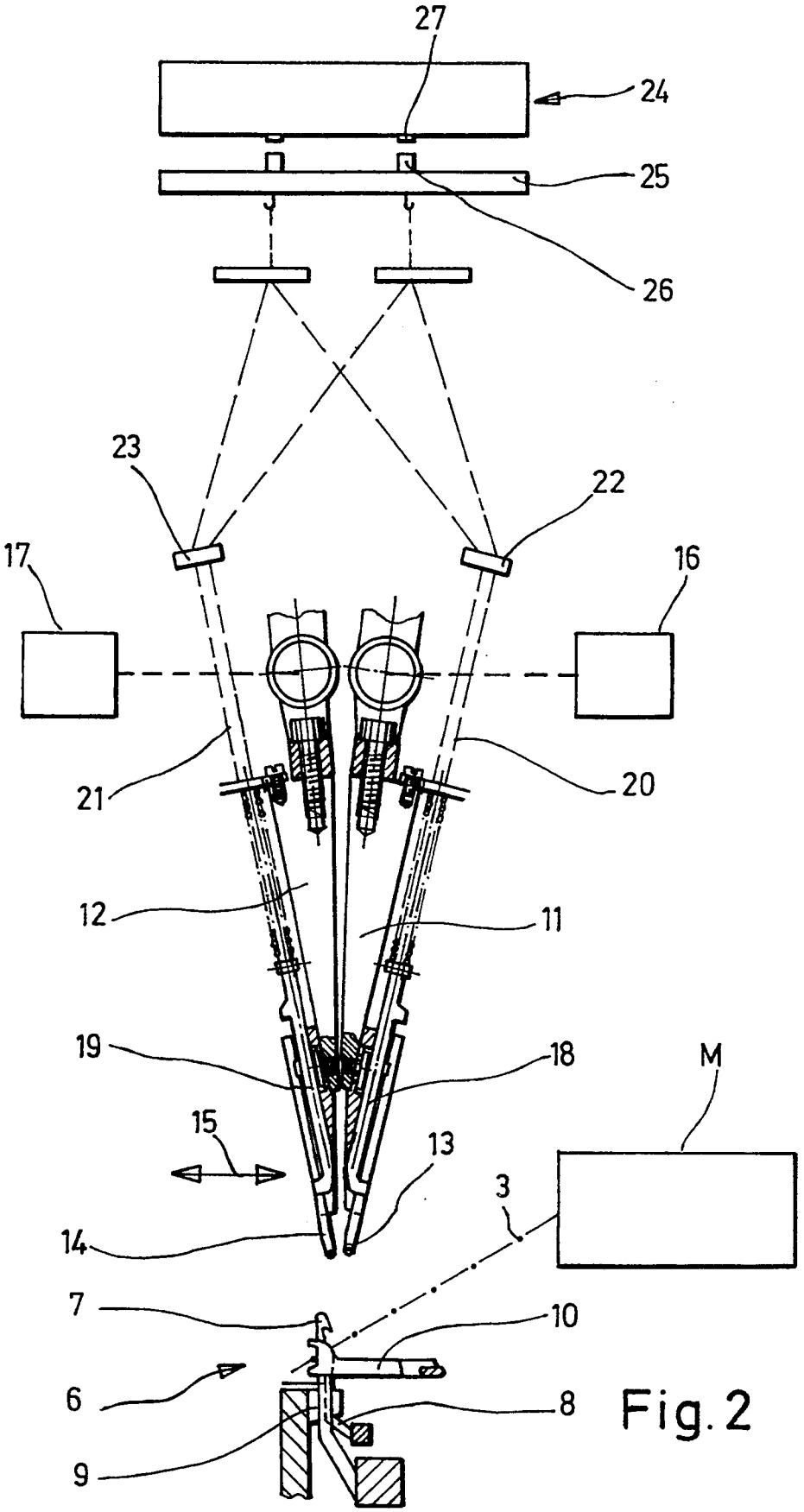
FIG. 2 is a schematic, elevational, crosssectional view of the working elements of a warp knitting machine appropriate to form the fabric of the present invention.

FIG. 2 schematically illustrates a portion of the warp knitting machine which is utilized to form the fabric of FIG. 1. The working area 6 comprises needles with sliders 8, knock-over sinkers 9 and forwarding means 10 for weft threads 3, supplied by magazine weft thread arrangement M. There are further provided a first jacquard guide bar 11 and a second jacquard guide bar 12, provided with corresponding guides 13 and 14. Both jacquard guide bars are swung behind and in front of the needles 7 in the conventional manner as is indicated by arrow 15. They are provided with a schematically illustrated shogging control arrangement 16 and 17 by means of which they are moveable back and forth, in a tricot lap manner.

The guides 13 and 14 can be displaced by one needle space by means of displacing elements 18 and 19. The displacing elements are operated in the usual manner by harness cords 20 and 21. These harness cords run through bars 22 and 23 and are activated by a common jacquard control arrangement 24. Arrangement 24 can be of a conventional construction and can have various means for sequencing the operation of the harness cords, such as a computer. For this purpose, holding elements 26 are provided to control element 27 by bar 25 and there, in accordance with a predetermined program, are either held or not held. For example, the control elements 27 may be electromagnets and the holding element 26 may be the appropriate anchors or armature.

In the illustrated construction the control element 25 operates on a pair of harness cords 20 and 21 in such a manner that two mutually corresponding guides 13 and 14 are displaced in mutually opposite directions.

Figure 3:
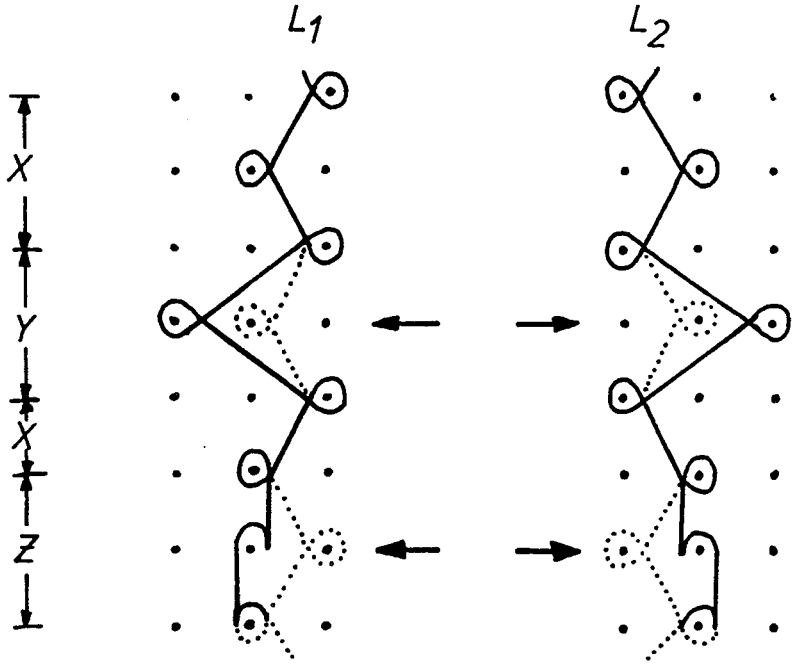
FIG. 3 is a diagram of the shogging and of the displacement of the jacquard guides.

FIG. 3 shows a lapping diagram by the jacquard guide bars 11 and 12. The jacquard guide bar 11 provides the lapping diagram L1 and the jacquard guide bar 12, the lapping diagram L2. When the guides are not displaced a tricot lap is provided in segment X. Following the displacement as shown by the arrows there is provided a tuch stitch in segment Y. In the displacement in the other end section there is provide a pillar stitch in segment Z. The segment Z is the first area 4 (FIG. 1) and the sum of segments X and Y give the second area 5.

The corresponding guides 13 and 14 which alternately lay a tricot stitch around needle 7 are activated by a common control element 27. The displacement however, proceeds in opposite directions. This in combination with the fact that the jacquard guide bars 11 and 12 are more laterally in opposite directions leads to the noted mirror image construction in both lapping diagrams.

Figure 4:
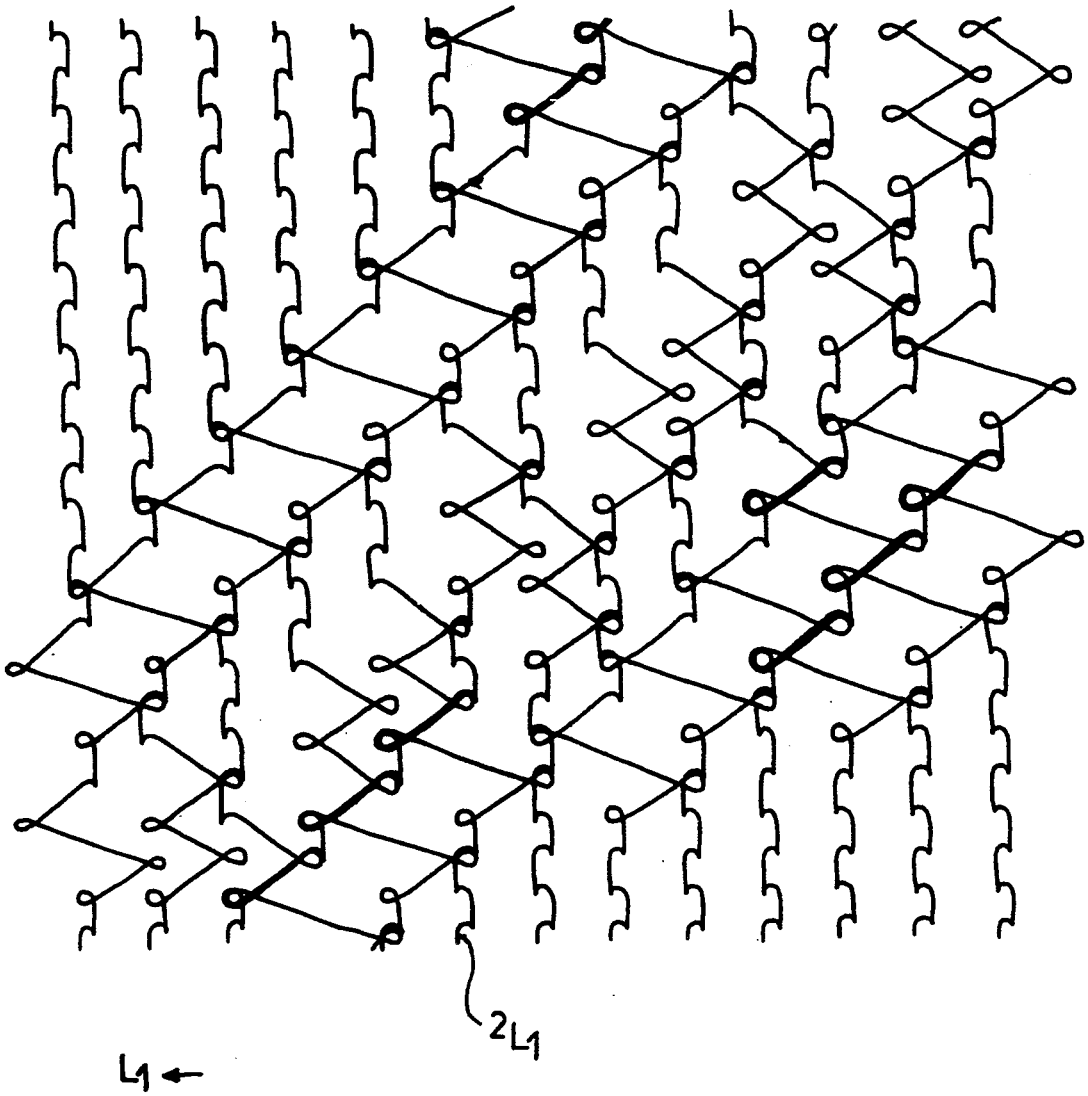
FIG. 4 is an example of the laying carried out by the first jacquard guide bar.

In FIG. 4 there is shown a portion of the composite lapping diagram L1 of the forward jacquard bar 11. It will be seen that each of the warp threads is laid in pillar stitch, tricot stitch and tuch stitch. In the transfer from one stitch form to the other, gaps are created, which means that in that position, needle 7 does not have a warp thread laid about it.

Figure 5:
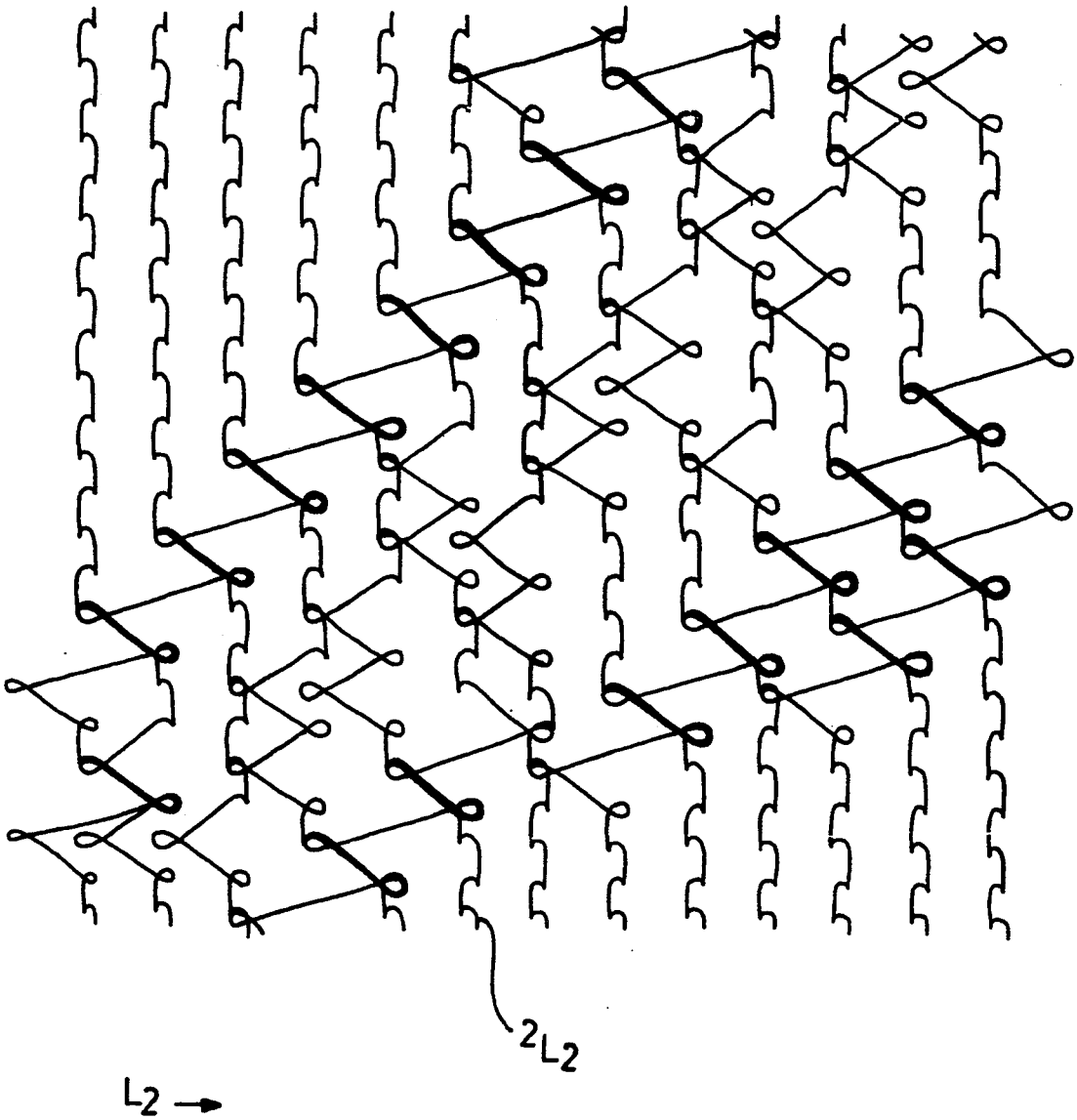
FIG. 5 is an example of the laying carried out by the second jacquard guide bar.

FIG. 5 shows the same area of the fabric for the lapping diagram L2 of the jacquard guide bar. In this situation the same description applies with the provision that the needles 7 left free by the first warp thread are laid about by the second warp thread. It is further to be noted that the mutual correspondence of the first and the second warp threads have a mirror image track which is shown in FIG. 3.

Figure 6:
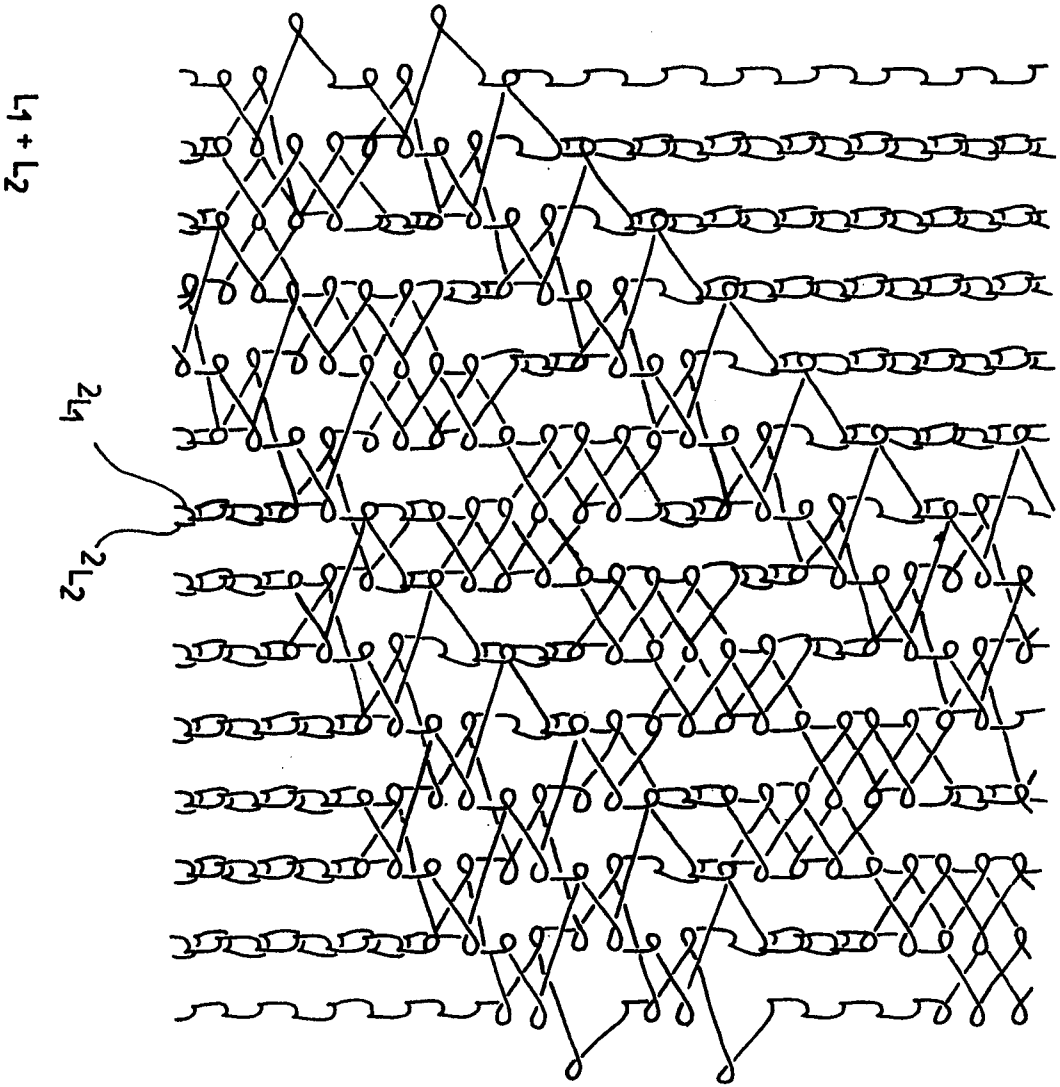
FIG. 6 is an example of the fabric obtained by the combination of both laying actions of FIGS. 4 and 5.

FIG. 6 shows the lapping diagram L1 + L2 which is given when at the same time both lapping systems are utilized. In each work cycle a plurality of needles have thread laid about them. There is thus provided, a complex patterning because of the path of the side segment of the warp thread stitches. In order to differentiate, the warp threads 2 which are laid by the first jacquard guide bar 11 are designated L1 and the weft threads 2 which are laid by the other jacquard guide bar 12 are designated L2. As is shown in FIG. 6, both of the systems of warp threads 2 can be laid in very different combinations starting with doubling such as, pillar-pillar, tricot-tricot, tuch-tuch, as well as mixtures such as pillar-tricot, pillar-tuch or tricot-tuch and all this also in straight run as well as in crossing.

It should further be noted that when a weft thread 3 is also laid in, which is differentially covered by the different lapping combinations, a very broad based form of patterning arises. For example, one may utilize a thicker weft thread 3 and thinner warp threads 2 in combination, whereby the covering of the weft thread by two warp threads gives an appearance that is lighter in weight than the exposed weft thread insert segment.

In one embodiment there is utilized polyester warp thread PE 110f 20 and acrylic weft thread Nm 14/2 which, utilizing substantially equal proportions of pillar, tricot and tuch in both warp thread systems leads to a maximal extension in the longitudinal direction of 19%.

When a further finishing process is utilized wherein the fabric is heated to a temperature of about 80° C., the longitudinal extension drops from 9% to about 5%.

It should of course, be understood that jacquard guide bars 11 and 12 are each controlled by their own jacquard arrangement 24, so that the warp threads of the two guide bars can thus be laid totally independently from each other, which leads to a patterning ground wear from the warp threads and weft insertion threads themselves.

The jacquard guide bars can also be displaced in the manner of a pillar stitch so that by means of displacement a tricot stitch is given. For simple patterns it is even possible to operate without jacquard guide bars and in place thereof, create the same stitch pattern on fully led weft threads in separately controllably guide bars.

We claim:

1. Warp knitting machine for forming fabric from weft threads and warp threads, comprising:

a needle bed having a plurality of needles;

a magazine weft thread arrangement for providing said weft threads to said needle bed;

first and second jacquard guide bars operative with said needle bed for providing a system of said warp threads;

first and second shogging control arrangements for reciprocating said first and second jacquard guide bars in a sequence for a tricot stitch;

first and second plurality of guides mounted on said first and second jacquard guide bars, respectively, and each of said first and second plurality of guides having separately mounted adjacent to each a displacing element operable to individually and selectively displace ones of said first and second plurality of guides to move their effective positions over one needle space;

a jacquard control arrangement means for (a) controlling said displacing element in said first and second plurality of guides in accordance with a predetermined pattern that sequentially reserves for successive wales, reserved ones of the needles in said needle bed, (b) selectively and sequentially displacing, in substantially each knitting cycle, a sequentially selected portion of the first plurality of guides to produce a pillar stitch, (c) altering motion of the sequentially selected portion of said guides to avoid the reserved ones of said needles and to cause said reversed ones of said needles to be devoid of warp threads from said first jacquard guide bar, and (d) controlling the guides of the second jacquard guide bar to lay warp threads about the reserved ones of said needles, together with other ones of said needles.

2. A warp knitting machine in accordance with claim 1 wherein said first and second shogging control arrangements produce lateral motions reciprocating between a first limit and a second limit, and wherein the jacquard control arrangement displaces the individual guides: (a) at the first limit to produce a pillar stitch, and (b) at the second limit to produce a tuch stitch.

3. A warp knitting machine in accordance with claim 2 wherein the first jacquard guide bar is mounted further forward than said second jacquard guide bar.

4. A warp knitting machine in accordance with claim 3 wherein said first and second jacquard guide bars are the only guide bars.

5. A warp knitting machine in accordance with claim 4 wherein said first and second shogging control arrangements each comprise means for simultaneously moving said first and second jacquard guide bars, respectively, laterally in mutually opposite directions and wherein the first and second plurality of guides are mounted to be simultaneously displaceable in mutually opposite directions, each of the first plurality of guides being associated in a predetermined manner with a corresponding one of the second plurality of guides to define a plurality of working pairs, said jacquard control arrangement having a plurality of control elements each operable to displace a corresponding one of said working pairs, each of said working pairs being operable to provide a tricot stitch about a limited number of the same needles.

6. A warp knitting machine in accordance with claim 1 wherein the first jacquard guide bar is the forwardmost one.

7. A warp knitting machine in accordance with claim 1 wherein said first and second jacquard guide bars are the only guide bars.

8. A warp knitting machine in accordance with claim 2 wherein said first and second jacquard guide bars are the only guide bars.

9. A warp knitting machine in accordance with claim 1 wherein said first and second jacquard guide bars are simultaneously moveable laterally in mutually opposite directions and wherein the first and second plurality of guides are simultaneously displaceable in mutually opposite directions, each of said first and each of said second plurality of guides being paired, said jacquard control arrangement having only a single control element for each of the pairs from said first and second plurality of guides for providing a tricot stitch about the same needles.

10. A warp knitting machine in accordance with claim 2 wherein said first and second jacquard guide bars are simultaneously moveable laterally in mutually opposite directions and wherein the first and second plurality of guides are simultaneously displaceable in mutually opposite directions, each of said first and each of said second plurality of guides being paired, said jacquard control arrangement having only a single control element for each of the pairs from said first and second plurality of guides for providing a tricot stitch about the same needles.

11. A warp knitting machine in accordance with claim 3 wherein said first and second jacquard guide bars are simultaneously moveable laterally in mutually opposite directions and wherein the first and second plurality of guides are simultaneously displaceable in mutually opposite directions, each of said first and each of said second plurality of guides being paired, said jacquard control arrangement having only a single control element for each of the pairs from said first and second plurality of guides for providing a tricot stitch about the same needles.

12. A method for handling weft threads and warp threads in a warp knitting machine having a needle bed with a plurality of needles, a magazine weft thread arrangement, and a first and second jacquard guide bar with a first and second plurality of guides, each with a displacing element, comprising the steps of:

providing said weft threads to said needle bed;

reciprocating said first and second jacquard guide bars to shog and produce a tricot stitch;

controlling said displacing element in said first and second plurality of guides, in substantially each knitting cycle, displacing a sequentially selected portion of the first plurality of guides to produce a pillar stitch, the sequentially selected portion of said guides having their pattern of motion altered to avoid reserved ones of said needles and to cause said reserved ones of said needles to be devoid of warp threads from said first jacquard guide bar, while controlling the guides of the second jacquard guide bar to lay warp threads about the reserved ones of said needles, together with other ones of said needles.

13. A method in accordance with claim 12 wherein the step of reciprocating said guide bars is performed by:

shogging said guide bars to reciprocate between first and second limits, the step of controlling said displacing element being performed by:

displacing the individual guides: (a) at the first limit to produce a pillar stitch, and (b) at the second limit to produce a tuch stitch.

14. A method in accordance with claim 13 wherein said first and second jacquard guide bars are simultaneously moveable to shog in mutually opposite directions and wherein the step of reciprocating said first and second guides are performed by:

displacing the first and second plurality of guides simultaneously in mutually opposite directions, each of said first plurality of guides being associated with a different corresponding one of said second plurality of guides to work in pairs that make complimentary motions.

15. A method in accordance with claim 12 wherein said first and second jacquard guide bars are simultaneously moveable to shog in mutually opposite directions and wherein the step of reciprocating said first and second guides are performed by:

displacing the first and second plurality of guides simultaneously in mutually opposite directions.

* * * * *